United States Patent [19]

Gaber

[11] 4,314,121

[45] Feb. 2, 1982

[54] SWITCH WITH SLIDING CONTACTOR

[75] Inventor: Martin Gaber, Wilmette, Ill.

[73] Assignee: Illinois Tool Works Inc., Chicago, Ill.

[21] Appl. No.: 198,676

[22] Filed: Oct. 20, 1980

[51] Int. Cl.[3] ..... H01H 13/28

[52] U.S. Cl. ..... 200/67 G; 200/275; 200/153 K; 200/339

[58] Field of Search ..... 200/67 G, 275, 252, 200/253, 260, 339, 16 R, 16 A, 16 C, 153 K

[56] References Cited

U.S. PATENT DOCUMENTS

| | | | |
|---|---|---|---|
| 2,874,338 | 2/1959 | Pease | 200/339 |
| 3,316,370 | 4/1967 | Ardizzi | 200/67 G |
| 4,127,754 | 11/1978 | Josemans et al. | 200/339 |
| 4,170,725 | 10/1979 | Farrell | 200/275 |

*Primary Examiner*—Willis Little

*Attorney, Agent, or Firm*—Glenn W. Bowen; Thomas W. Buckman

[57] ABSTRACT

A switch construction including opposed contacts positioned on a base and a bridging sliding contactor slidable between different switch positions. The design of the contacts on the base includes an upper section that defines a first surface engageable by a tab formed on the sliding contactor, and second surface blade portions which provide engagement with wing sections defined on opposite sides of a tab section formed on the sliding contactor. Resilient means press the sliding contactor against this upper section in a fashion such that the wing sections slide over the second surface portions and the tab section engages the first surface portions. The separate engagement of the tab and wing sections provide separate available current paths for the switch; and since either the tab or the wing sections may engage the contact first, arcing is confined to this initial contact area during switch closure. The other section may then act as an inclined plane during switch closure to help lift off the arcing section away from the initial contact area after arcing occurs. The section that is engaged in the maintained state of the switch is thus a clean contact area at which no arcing has occurred. Similarly, upon opening of the switch circuit the initial contact point is also the last point of the sliding contactor that contacts the stationary contact, and thus arcing is again confined to this area.

9 Claims, 16 Drawing Figures

SWITCH WITH SLIDING CONTACTOR

BACKGROUND OF THE INVENTION

1. Field Of The Invention

This invention is related to switch constructions which involve the use of stationary and movable contacts. The invention is particularly concerned with constructions of this type wherein the movable contact is adapted to bridge opposed stationary contacts with the movable contact being adapted to slide between different positions. The switch may involve the use of two or more contacts whereby different current paths are provided. On the other hand, a switch position may involve an open contact.

It is desirable to provide switches which are quite small but which are still capable of handling sizeable current. It has been recognized, however, that such switches can be relatively expensive if they are to be considered reliable. One problem which is particularly significant is the occurrence of arcing which is, of course, more pronounced when higher currents are involved. When the arcing occurs, contacts may be contaminated whereby the switch function is materially impaired. Another serious problem is the build up of heat in high current applications.

BACKGROUND OF THE INVENTION

Stearns U.S. Pat. Nos. 1,892,542, Batcheller 2,432,647, Heusser 2,782,279 and Farrell 4,170,725 are representative of switches in the prior art which are characterized by a base having stationary contacts with a bridging contactor movable between different switch positions. In the case of the Stearns patent, the bridging contactor slides in response to the movement of a pivotally mounted, spring loaded, actuator. A fulcrum located between a pair of outside contacts results in pivoting movement of the bridging contactor in the course of its sliding movement. Batcheller and Heusser illustrate substantially one-piece contacts movable between different switch positions. Farrell is owned by the assignee of the present invention and is directed to a switch that is substantially identical to the switch of the present invention except for the structure of the sliding contactor. The sliding contactor structure of the present invention provides an electrical contactor which operates at appreciably cooler temperatures for the same current load and in addition has more contact pressure and wiping surfaces. The switch of the present invention is thus useful for higher current switching applications than the switch of the Farrell patent, which is nevertheless a relatively high current switch.

TECHNICAL DESCRIPTION OF THE INVENTION

Figure 1:
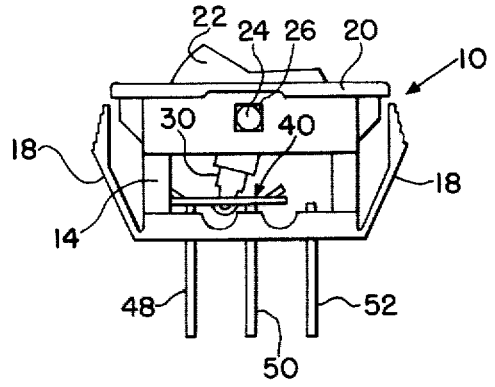
FIG. 1 comprises a side view of one embodiment of a switch construction characterized by the features of this invention with a side wall removed.

The particular switch construction of this invention comprises opposed contacts positioned on a base. A bridging contactor is supported over the base, and actuator means serve to move this contactor between first and second positions to achieve the switching operation. FIGS. 1–8 of the drawings illustrate one embodiment of a switch 10 in accordance with the present invention that comprises a molded housing including a base 12, end walls 14 and side walls 16. A pair of legs 18 are formed integrally with the base, and these legs are adapted to be pressed inwardly so that the switch can be forced into an opening defined in a panel with the flange 20 limiting the inward movement and with the resilient legs pressing outwardly to hold the switch in place.

A molded actuator 22 includes trunnions 24 which are received in openings 26 defined by side walls 16. The actuator defines an internal bore 28 which receives piston 30. In addition, spring 32 is received within the bore 34 formed in the piston. This spring thus normally urges the piston outwardly relative to the actuator.

Figure 2:
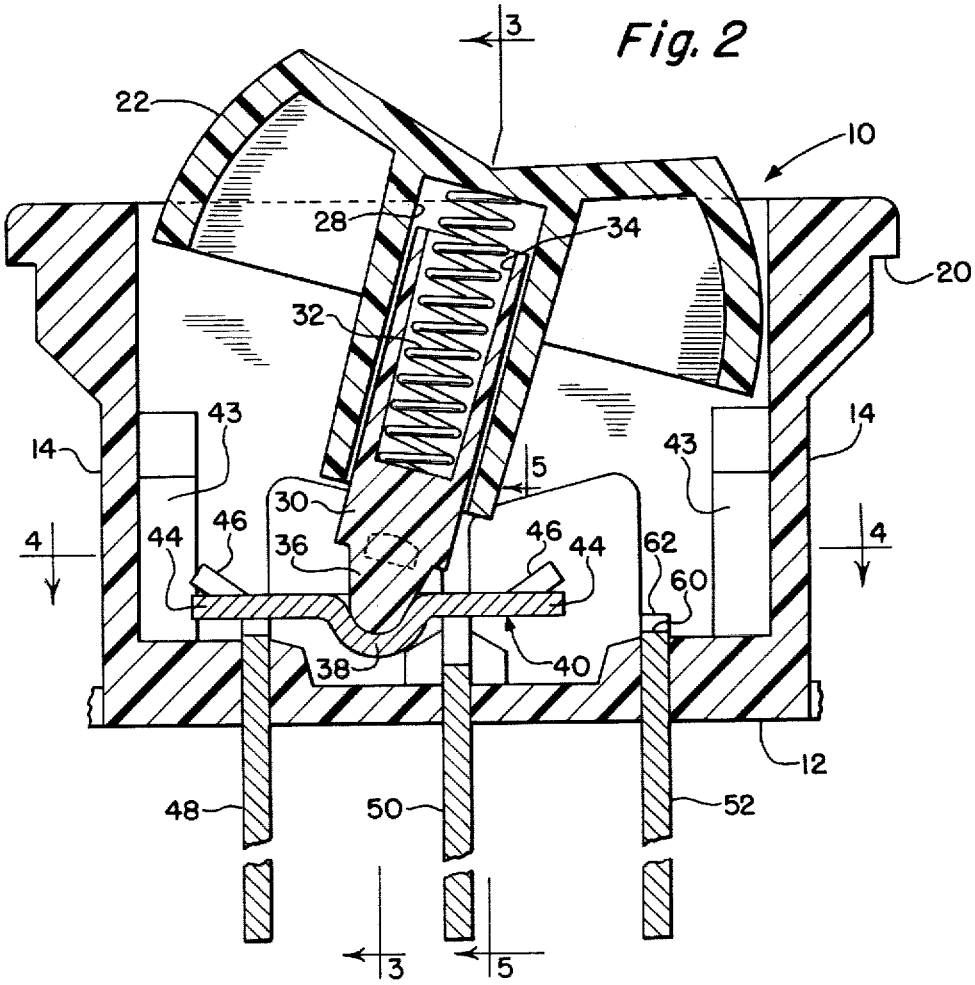
FIG. 2 is an enlarged vertical, sectional view of the switch construction of FIG. 1 which is taken along the lines 2—2 of FIG. 3.
Figure 3:
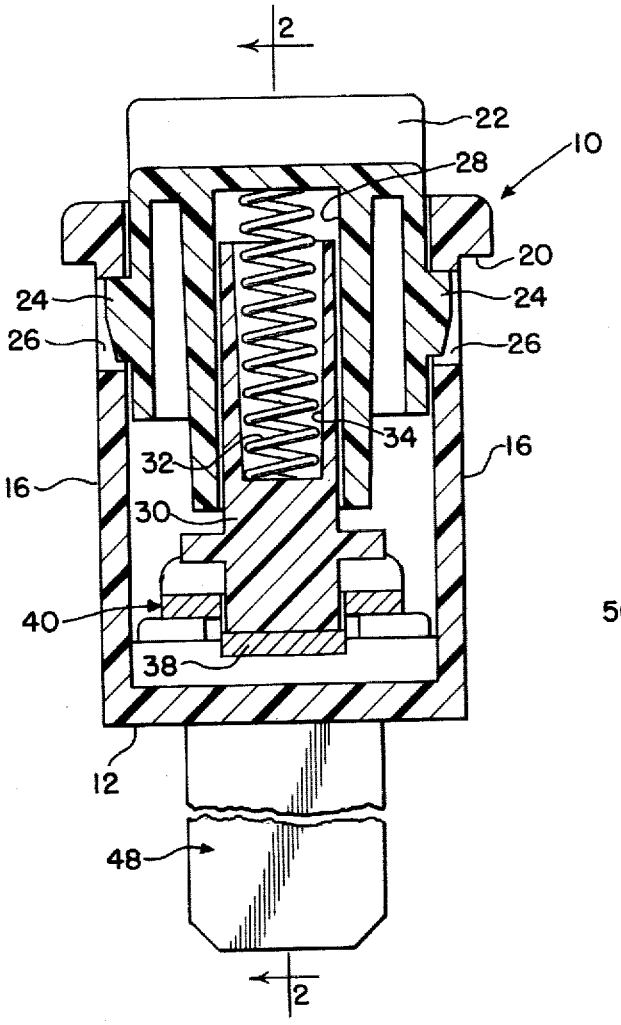
FIG. 3 is a cross-sectional view taken about the line 3—3 of FIG. 2 with the sliding contactor in a maintained closed state across two contacts.
Figure 5:
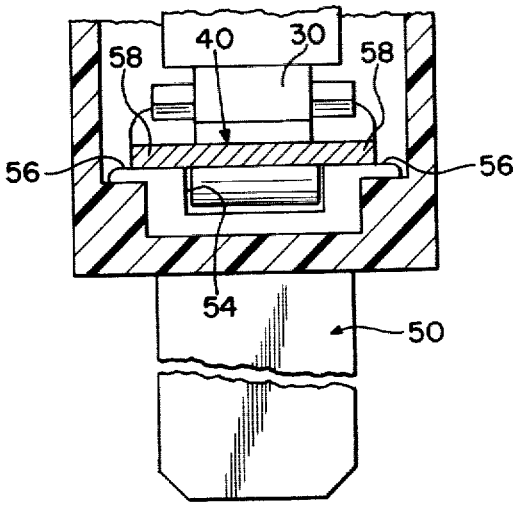
FIG. 5 is a fragmentary, cross-sectional view taken about the line 5—5 of FIG. 2.
Figure 4:
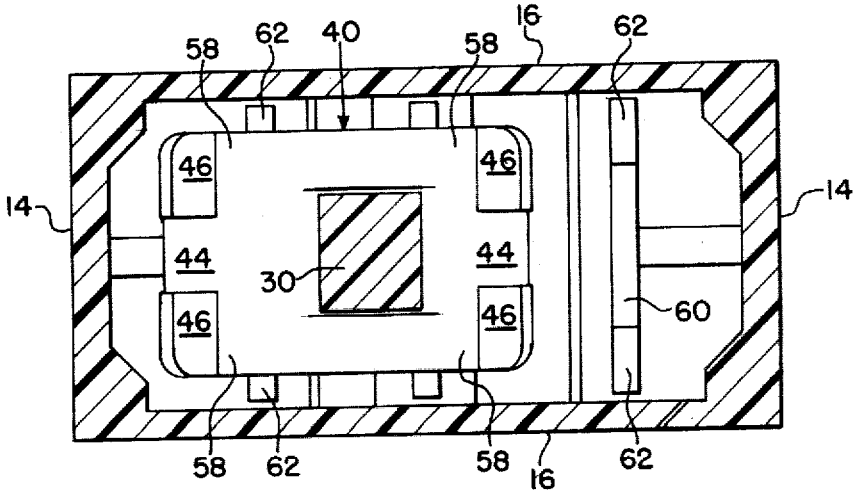
FIG. 4 is a cross-sectional view taken about the line 4—4 of FIG. 2.

The piston defines a nose 36 which is received by hammock 38 formed in bridging contactor 40. The bridging contactor 40 includes a pair of outwardly extending tab sections 44. Wings 46 are defined on opposite sides of each tab section which are struck upwardly at an acute angle relative to the plane of the tabs 44. As best shown in FIG. 2, the length of the contactor 40 is such that it easily bridges the upper ends of a pair of stationary contacts supported on the base 12. These stationary contacts include outer contact 48, and intermediate contact 50, and another outer contact 52.

Figure 7:
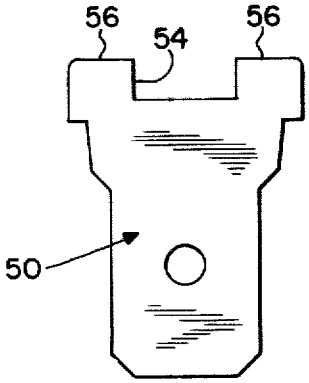
FIG. 7 is an elevational view of a stationary intermediate contact utilized in the construction of FIG. 3.

FIG. 7 illustrates the structure of intermediate contact 50. This contact, in particular, includes an upper section defining cutout portion 54 and raised bearing surfaces 56 which are engaged by the side portions 58 of bridging contactor 40. The cutout section is provided to permit free movement of the hammock 38 during a switching operation.

Figure 6:
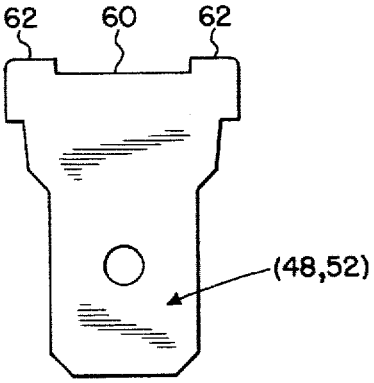
FIG. 6 is an elevational view of a stationary outer contact utilized in the construction of FIG. 3.

The generally flat outer contacts 48 and 52 illustrated in FIG. 6 define an upper section including central portion 60. On opposite sides of this identation, there are provided a pair of offset raised portions 62. The contacts shown in both FIGS. 6 and 7 preferably consist of blade-like members whereby the configurations designated can be readily formed utilizing simple stamping equipment.

In the operation of the construction, the actuator 22 is employed for determining switch positions. FIG. 2 illustrates the switch in one position, and if the upwardly protruding actuator end is depressed, the bridging contactor 40 will be forced from left to right whereby the opposite switch position is achieved. In the construction described, all three stationary contacts may be connected in a circuit so that the switch will serve to complete a circuit in either position. It will be apparent that one of the contacts 48 and 52 could be open so that the switch will merely serve as an "on-off" switch.

The bridging contactor 40 provides redundant engaging portions for conducting current. Thus, it will be appreciated that in the course of a switching operation, one pair of wings 46 will be the first portions of the contact engaging the surface defined by the offset portion 62 of a stationary contact. As the bridging contactor completes its movement, the wings 46 wipe across the offset portion 62 thereby minimizing the potential for build-up of contaminants of the engaging surfaces.

Figure 8:
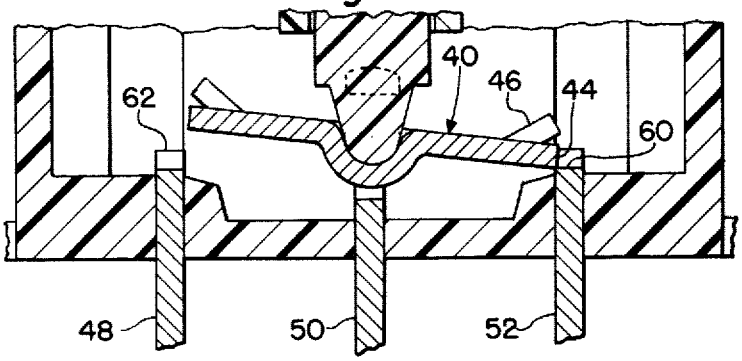
FIG. 8 is a fragmentary, cross-sectional view of the switch of FIG. 3 which shows the sliding contactor in the position it assumes when arcing occurs either upon opening or closure of the switch which is taken along the lines 2—2 of FIG. 3.

The contact of the wings 46 and the offset portions 62 is made after contact of the tab 44 and the central portion 60, during switch closure, which confines arcing to the central portion 60. Upon opening of the contact the wings 46 leave engagement with the offset portions 62 before the tab leaves engagement with the central portion 60, again confining arcing to the central portion. FIG. 8 represents both the initial contact of the tab 44 with the contact 52 upon closure of the circuit between the contacts 50 and 52 and the last contact of the contactor with the contact 52 upon opening of this connection for the construction of FIG. 3, which shows that the wings are separated from the offset portions 62 by an appreciable distance when the tab 44 is in contact with the central portion 60. The tabs 44 lie in a plane generally normal to the plane of the flat contacts 48, 52, when the circuit is closed for the switch of FIG. 2.

While the switch remains closed between two contacts, however, the tabs are lifted off of the central portions 60, since the wings act as inclined planes, and the circuit is then maintained through the clean contact, multiple wiping surfaces of the wings and the offset portions of the outer contact. These redundant surfaces provided higher conductivity and lower heat build-up since arcing is confined to the tab area of the sliding contactor. Limitation of the movement of the slide contactor 40 is provided by the stops 43 integrally formed in the wall 14 which limits the degree of rocking action of the actuator 22.

Figure 9:
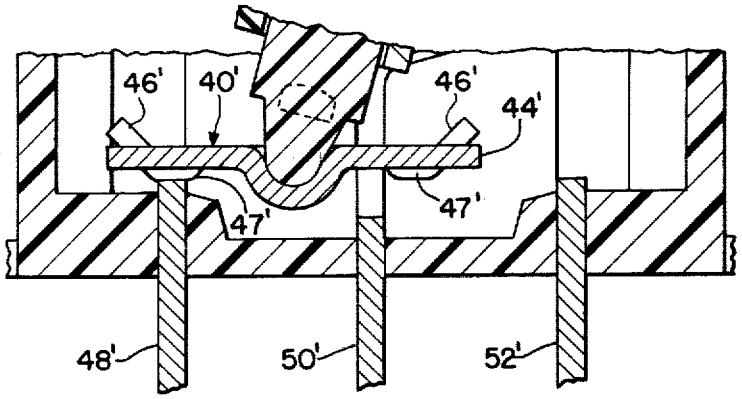
FIG. 9 is a fragmentary, cross-sectional view of an alternate embodiment of the switch with the sliding contactor in a maintained closed state across two contacts.
Figure 11:
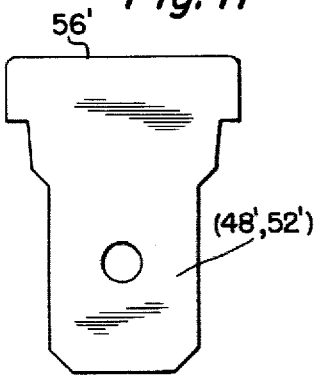
FIG. 11 is an elevational view of a stationary outer contact utilized in the construction of FIG. 9.
Figure 10:
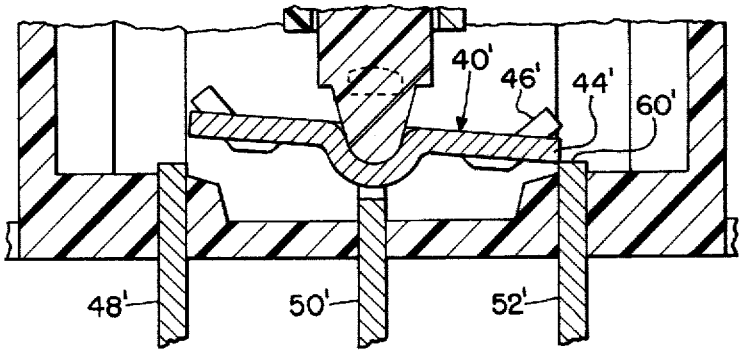
FIG. 10 is a fragmentary, cross-sectional view of the embodiment of FIG. 9 which shows the sliding contactor in the position it assumes when arcing occurs either upon opening or closure of the switch.

FIGS. 9–11 represent an alternate embodiment of the switch of the present invention in which the wings 46', in addition to having their outer portions inclined with respect to the plane of the tabs 44', are each also formed to have a downwardly extending segment 47'. This allows the stationary outer contacts to be constructed as shown in FIG. 11 wherein the raised bearing surface 56' of the outer contacts 48', 52' is a straight section without a cut-out thus simplifying somewhat the construction of the contacts 48', 52'.

As shown in FIG. 9, which is a view similar to the showing of FIG. 2, the downwardly extending segment 47' is in contact with the bearing surface 56' of the contact 48' when the switch is in the closed position with the bridging contactor 40' also making contact with the intermediate contact 50'. FIG. 10 is a view similar to the showing of FIG. 8 which shows again that arcing is confined in this embodiment also to central portion 60' of the contact 52' and to the tab 44'.

Figure 12:
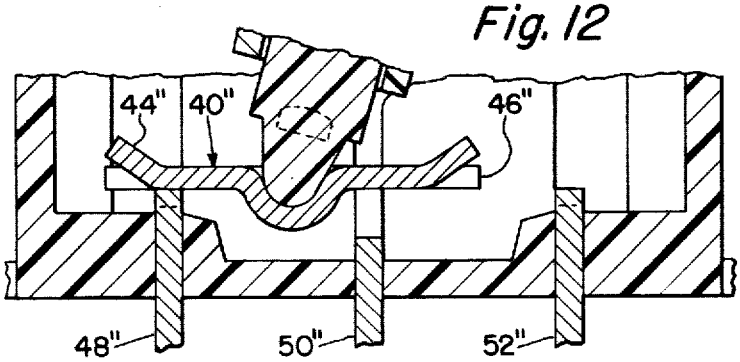
FIG. 12 is a fragmentary, cross-sectional view of an additional alternate embodiment of the switch with the sliding contactor in a maintained closed state across two contacts.
Figure 14:
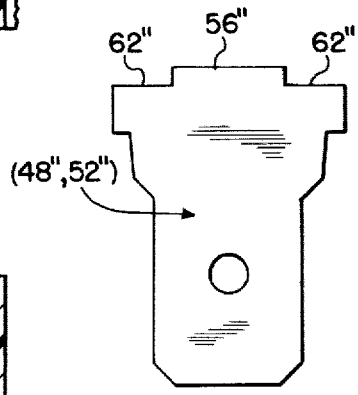
FIG. 14 is an elevational view of a stationary outer contact utilized in the construction of FIG. 12.
Figure 13:
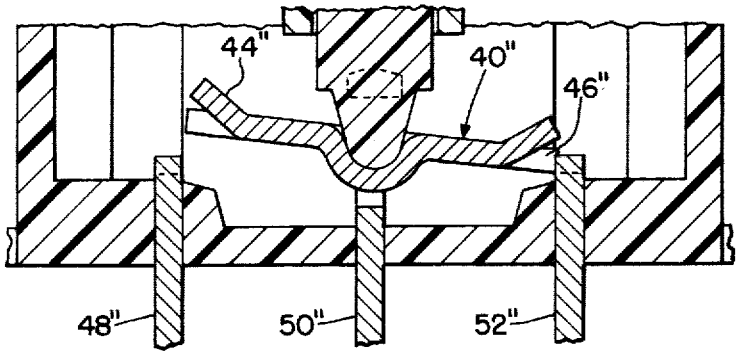
FIG. 13 is a fragmentary, cross-sectional view of the embodiment of FIG. 12 which shows the sliding contactor in the position it assumes when arcing occurs either upon opening or closing of the switch.

FIGS. 12–14 shows another embodiment of the switch of the present invention. In this embodiment, the configuration and the function of the wings are interchanged and altered by constructing the bridging contactor 40'' so that the wings 46'' extend generally normal to contacts 48'', 52'', and the tabs 44'' are struck upwardly at an acute angle with respect to the wings 46'' at their ends. The outer contacts 48'', 52'' in this instance are constructed as shown in FIG. 14 wherein the raised intermediate bearing contact surface 56'' projects upwardly at the center portion of the contact 52'' above the outer bearing surfaces 62''.

The raised bearing surface 56'' in the embodiment of FIGS. 12–14 makes contact with the tabs 44'' which act as inclined planes to lift the wings 46'' out of contact with the bearing surfaces 62''. Thus, arcing in this embodiment is confined to the wings 46'' and the bearing contact surface 56'', which as shown in FIG. 13 are initially in contact before the tabs 44'' contact the surfaces 62'', thus maintaining these surfaces as clean contact surfaces, as best illustrated in FIG. 13.

Figure 15:
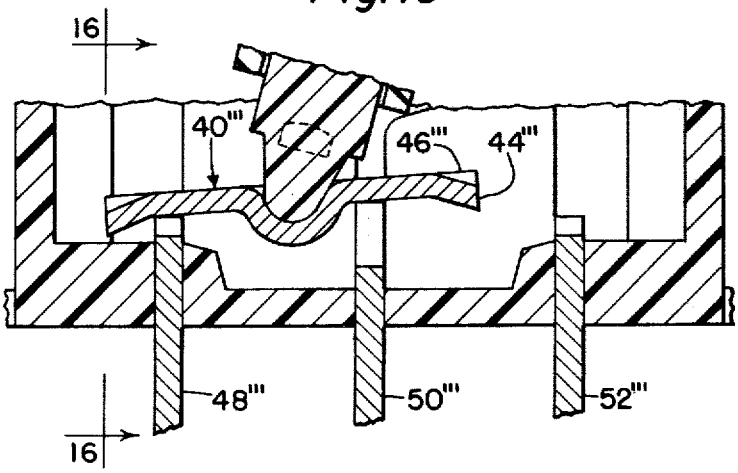
FIG. 15 is a fragmentary, cross-sectional view of a further alternate embodiment of the switch with the sliding contactor in a maintained closed state across two contacts.
Figure 16:
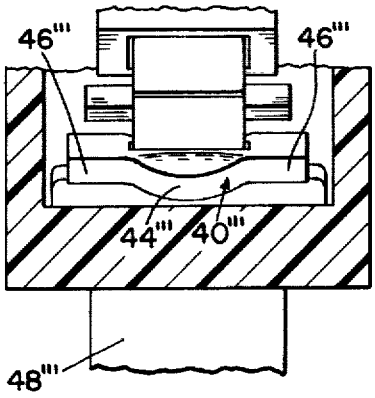
FIG. 16 is a fragmentary, end cross-sectional view of the switch of FIG. 15.

FIG. 15 represents a still further embodiment of the present invention in which the bridging contactor 40''' is made as a single continuous surface element without having either struck out wings or struck out tabs. Instead, this contactor 40''' is bent, 25 best shown in FIG. 16, so that the central section 44''' of the contactor is bent downwardly and lower than the outer sections 46'''. Thus, the central section 44''' of the contactor 40''' effectively acts in the same manner as the tab section of the embodiment of FIG. 2, while the outer sections 46''' effectively act in the same manner as the struck out wing portions of the embodiment of FIG. 2. The outer contacts 48''', 52''' may be constructed in the same manner as the contacts 48, 52 shown in FIG. 6 in the embodiment of FIGS. 15, 16. In the embodiments of FIGS. 8–13 the intermediate contacts 58'' and 58''' may be constructed in the manner shown for the contact 58 of FIG. 7.

It will be appreciated that variations in the design of certain portions of the switch are feasible. For example, actuators as described in the prior art patents referred to as well as those otherwise contemplated in this art may be used with the switch design of this invention. It will further be understood that various other changes and modifications may be made in the construction described which provide the characteristics of the invention without departing from the spirit thereof particularly as defined in the following claims.

I claim:

1. In a switch construction comprising a plurality of opposed generally flat contacts, a sliding bridging contactor, actuator means for sliding said contactor relative to said contacts so that said contactor is shifted by said actuator means between a first position at which it completes a circuit by engaging two of said contacts and a second position at which said contactor is shifted out of engagement with at least one of said previously engaged contacts, wherein at least one of said opposed contacts comprises first and second engagement surfaces, the improvement wherein said contactor comprises a first contact surface means moveable into engagement with said first engagement surface and a second contact surface means moveable into engagement with said second engagement surface, which are located relative to each other so that;

(a) said first contact surface means contacts said first engagement surface before said second contact surface means contacts said second engagement surface, and said first contact surface means disengages from contact with said first engagement surface after said second contact surface comes into contact with said second engagement surface during closure of said circuit between said two contacts, and (b) said first contact surface means again contacts said first engagement surface and remains in contact with said first engagement surface until after said second contact means disengages from contact with said second engagement surfaces during opening of said circuit, thereby confining the major portion of any arcing that occurs to said first contact surface means and said first engagement surface.

2. The improvement of claim 1 wherein said first and second contact surface means are located at different levels and said first and second engagement surfaces are also located at different levels such that engagement of said second contact surface means and second engagement surface causes said first contact surface means to separate from said first engagement surface during the closure of said circuit between said two contacts as said contactor slides to its closed position, and such that said separated first contact surface means and said first engagement surface are brought into engagement during opening of said circuit as said contactor slides to its open position.

3. The improvement of claim 2 wherein said second contact surface means acts as an inclined lifting plane relative to said second engagement surface so as to lift said first contact surface means from said first engagement surface during closure of said circuit.

4. The improvement of claim 3 wherein said second contact surface means comprises a pair of wings that are inclined away from said contacts and said first contact surface means comprises a tab which is located intermediate said wings and that lies in a direction generally normal to said contacts when said circuit is closed.

5. The improvement of claim 4 wherein said wings are struck-out of a surface that comprises said tab.

6. The improvement of claim 4 wherein said wings and said tab are formed from one bent continuous surface.

7. The improvement of claim 3 wherein said second contact surface means comprises a tab that is inclined away from said contacts and said first contact surface means comprises a pair of wings on opposite sides of said tab which lie in a direction generally normal to said contacts when said circuit is closed.

8. The improvement of claim 7 wherein said tabs are struck-out of a surface that comprises said wings.

9. The improvement of claim 7 wherein said wings and said tab are formed from one bent continuous surface.

* * * * *